US006422384B1

(12) United States Patent
Roederer

(10) Patent No.: US 6,422,384 B1
(45) Date of Patent: Jul. 23, 2002

(54) PORTABLE JEWELRY TRAVEL CASE AND DISPLAY

(76) Inventor: Veronica Roederer, 3709 Spruce Dr., Myrtle Beach, SC (US) 29577

( * ) Notice: Subject to any disclaimer, the term of this patent is extended or adjusted under 35 U.S.C. 154(b) by 0 days.

(21) Appl. No.: 09/804,998

(22) Filed: Mar. 12, 2001

(51) Int. Cl.[7] ..... A45C 11/04

(52) U.S. Cl. ..... 206/6.1; 206/566

(58) Field of Search ..... 206/6.1, 566, 419, 206/420; 248/127, 150, 151, 163.1, 176.1

(56) References Cited

U.S. PATENT DOCUMENTS

| | | | | | |
|---|---|---|---|---|---|
| 4,461,383 | A | | 7/1984 | Groff | |
| 4,854,656 | A | | 8/1989 | O'Keefe | |
| D315,460 | S | * | 3/1991 | Sorce, Jr. | D6/469 |
| 5,033,619 | A | * | 7/1991 | Garis | 206/419 |
| 5,033,625 | A | * | 7/1991 | Campbell | 211/13 |
| 5,064,067 | A | * | 11/1991 | McAllister et al. | 206/420 |
| 5,117,971 | A | * | 6/1992 | Fisher | 206/6.1 |
| D328,681 | S | * | 8/1992 | Radosevich | D6/512 |
| 5,168,999 | A | * | 12/1992 | Lee et al. | 206/420 |
| D334,672 | S | * | 4/1993 | Bradwell et al. | D6/469 |
| 5,617,948 | A | * | 4/1997 | Rainey | 206/6.1 |
| 5,653,339 | A | * | 8/1997 | Dobson | 206/429 |
| D400,104 | S | * | 10/1998 | Ash et al. | D9/457 |
| 5,890,587 | A | | 4/1999 | Roegner | |
| D428,533 | S | * | 4/2000 | Carroll | D28/73 |
| D424,329 | S | * | 5/2000 | Lundberg | D6/457 |

* cited by examiner

*Primary Examiner*—Shian Luong
(74) *Attorney, Agent, or Firm*—Goldstein & Lavas, P.C.

(57) ABSTRACT

A portable jewelry travel case and display including a panel portion having an outer periphery defined by an upper edge, a lower edge, and opposed side edges. The outer periphery has a plurality of recesses extending inwardly thereof in a spaced relationship. The lower edge has a pair of larger recesses extending upwardly thereof in a spaced relationship. A base stand is adapted for supporting the panel portion in an upright orientation.

4 Claims, 2 Drawing Sheets

PORTABLE JEWELRY TRAVEL CASE AND DISPLAY

BACKGROUND OF THE INVENTION

The present invention relates to a portable jewelry travel case and display and more particularly pertains to allowing jewelry to be transported and displayed without being damaged.

Many people, particularly women, have many items of jewelry which they often bring along with them when traveling. These many items of jewelry are often all placed in a single pouch or loosely in a purse or suitcase. This often leaves the items disorganized, sometimes tangled and often makes it difficult to easily locate and match mating pairs.

There have been devices that have been made that allow certain jewelry items to be carried in a way so as to prevent them from becoming tangled and disorganized. However, these devices do not allow the jewelry to be displayed in a manner similar to how the person's jewelry case at home would. Thus, there is a need for a travel case for jewelry that stores and organizes items of jewelry, and allows the items to be displayed for the user to easily select the items needed at a particular time.

The present invention attempts to solve the abovementioned problem by providing a jewelry travel case that holds and organizes items of jewelry for travel that can be converted into a display so that the user can easily select a particular item when needed.

The use of jewelry storage devices is known in the prior art. More specifically, jewelry storage devices heretofore devised and utilized for the purpose of storing jewelry are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,890,587 to Roegner discloses a jewelry case comprised of a number of pockets and panels for carrying various articles, such as earrings and necklaces. U.S. Pat. No. 4,461,383 to Groff and U.S. Pat. No. 4,854,656 to O'Keefe disclose jewelry storage devices for holding necklaces in a tangle-free manner.

While these devices fulfill their respective, particular objective and requirements, the aforementioned patents do not describe a portable jewelry travel case and display for allowing jewelry to be transported and displayed without being damaged.

In this respect, the portable jewelry travel case and display according to the present invention substantially departs from the conventional concepts and designs of the prior art, and in doing so provides an apparatus primarily developed for the purpose of allowing jewelry to be transported and displayed without being damaged.

Therefore, it can be appreciated that there exists a continuing need for a new and improved portable jewelry travel case and display which can be used for allowing jewelry to be transported and displayed without being damaged. In this regard, the present invention substantially fulfills this need.

SUMMARY OF THE INVENTION

In the view of the foregoing disadvantages inherent in the known types of jewelry storage devices now present in the prior art, the present invention provides an improved portable jewelry travel case and display. As such, the general purpose of the present invention, which will be described subsequently in greater detail, is to provide a new and improved portable jewelry travel case and display which has all the advantages of the prior art and none of the disadvantages.

To attain this, the present invention essentially comprises a panel portion having a generally rectangular configuration. The panel portion has an outer periphery defined by an upper edge, a lower edge, and opposed side edges. The outer periphery has a plurality of triangular recesses extending inwardly thereof in a spaced relationship. The lower edge has a pair of larger recesses extending upwardly thereof in a spaced relationship. The panel portion has a plurality of apertures' therethrough in a spaced relationship downwardly of the upper edge. The panel portion has a central recess formed on a front surface thereof. A travel pouch is dimensioned for receiving the panel portion therein. The travel pouch has an open upper end for receiving the travel pouch therein. The open upper end includes a closable cover. The travel pouch has a supplemental small pouch disposed on a front surface thereof. The supplemental small pouch has an open upper end including a closable flap. A base stand is adapted for supporting the panel portion in an upright orientation. The base stand comprises a pair of horizontally disposed legs positioned in a spaced side-by-side orientation.

The legs have rearward ends receivable within the pair of larger recesses in the lower edge of the panel portion. The legs have forward ends having a storage container secured thereto. The storage container has an elongated semi-cylindrical configuration defined by an open upper end for receiving items therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable jewelry travel case and display which has all the advantages of the prior art jewelry storage devices and none of the disadvantages.

It is another object of the present invention to provide a new and improved portable jewelry travel case and display which may be easily and efficiently manufactured and marketed.

It is a further object of the present invention to provide a new and improved portable jewelry travel case and display which is of durable and reliable construction.

An even further object of the present invention is to provide a new and improved portable jewelry travel case and display which is susceptible of a low cost of manufacture with regard to both materials and labor, and which accordingly is then susceptible of low prices of sale to the consuming public, thereby making such a portable jewelry travel case and display economically available to the buying public.

Even still another object of the present invention is to provide a new and improved portable jewelry travel case and display for allowing jewelry to be transported and displayed without being damaged.

Lastly, it is an object of the present invention to provide a new and improved portable jewelry travel case and display including a panel portion having an outer periphery defined by an upper edge, a lower edge, and opposed side edges. The outer periphery has a plurality of recesses extending inwardly thereof in a spaced relationship. The lower edge has a pair of larger recesses extending upwardly thereof in a spaced relationship. A base stand is adapted for supporting the panel portion in an upright orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
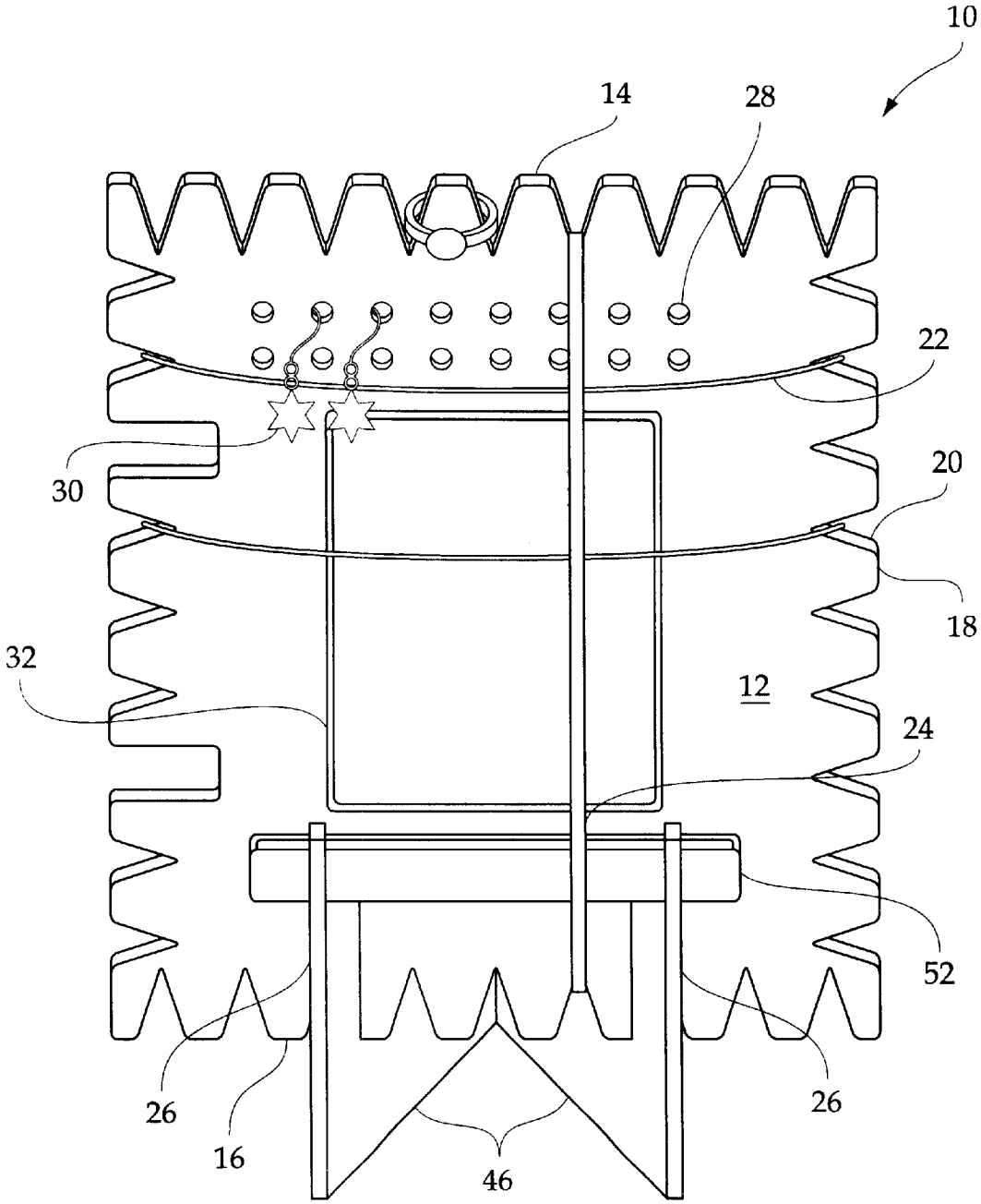
FIG. 1 is a perspective view of the preferred embodiment of the portable jewelry travel case and display constructed in accordance with the principles of the present invention.
Figure 3:
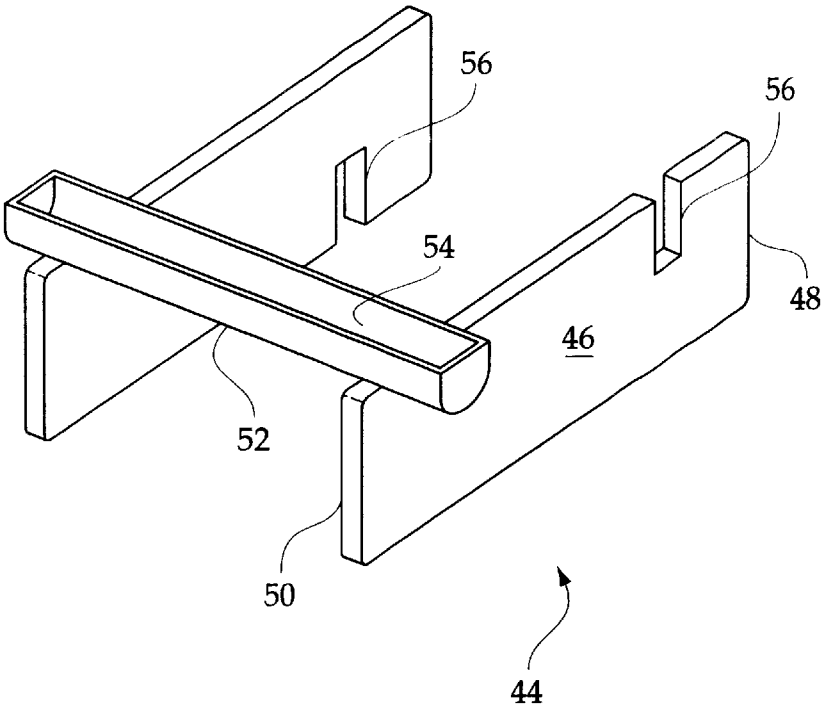
FIG. 3 is a perspective view of the base stand of the present invention.

With reference now to the drawings, and in particular, to FIGS. 1 through three thereof, the preferred embodiment of the new and improved portable jewelry travel case and display embodying the principles and concepts of the present invention and generally designated by the reference number 10 will be described.

Specifically, it will be noted in the various Figures that the device relates to a portable jewelry travel case and display for allowing jewelry to be transported and displayed without being damaged. In its broadest context, the device consists of a panel portion, a travel pouch, and a base stand. Such components are individually configured and correlated with respect to each other so as to attain the desired objective.

The panel portion 12 has a generally rectangular configuration. The panel portion 12 has an outer periphery defined by an upper edge 14, a lower edge 16, and opposed side edges 18. The outer periphery has a plurality of triangular recesses 20 extending inwardly thereof in a spaced relationship. The recesses allow a user to extend a necklace 22 between the corresponding recesses 20 on the opposed side edges 18 so that the necklace won't become tangled during travel. Additionally, an elastic band 24 can be extending between the corresponding recesses 20 on the upper and lower edges 14,16 to hold the necklace 22 against the panel portion 12. Note FIG. 1. The lower edge 16 has a pair of larger recesses 26 extending upwardly thereof in a spaced relationship. The panel portion 12 has a plurality of apertures 28 therethrough in a spaced relationship downwardly of the upper edge 14. The plurality of apertures 28 are used to hold earrings 30. The earrings 30 are threaded through the apertures 28 and then their backings will be replaced behind the panel portion 12 to hold earrings 30 in place with respect to the panel portion 12. Note FIG. 1. The panel portion 12 has a central recess 32 formed on a front surface thereof. The central recess 32 can be used to hold a small mirror or selected photograph therein.

Figure 2:
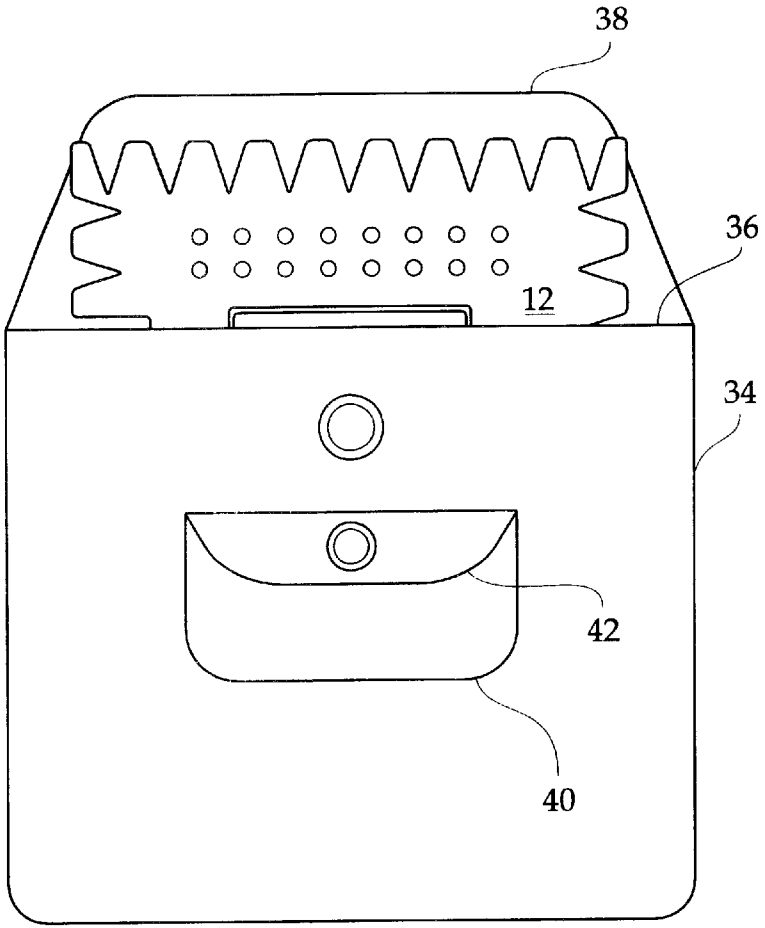
FIG. 2 is a front view of the present invention illustrating the use of the travel pouch.

The travel pouch 34 is dimensioned for receiving the panel portion 12 therein. Note FIG. 2. The travel pouch 34 has an open upper end 36 for receiving the panel portion 12 therein. The open upper end 36 includes a closable cover 38. The travel pouch 34 has a supplemental small pouch 40 disposed on a front surface thereof. The supplemental small pouch 40 has an open upper end including a closable flap 42. The supplemental small pouch 40 can be used to hold small pieces of jewelry therein that cannot be accommodated by the panel portion 12. The travel pouch 34 will hold the panel portion 12 therein when storing necklaces 22 and earring's 30 thereon when being stored in a suitcase or the like for travel.

The base stand 44 is adapted for supporting the panel portion 12 in an upright orientation. Note FIG. 1. The base stand 44 comprises a pair of horizontally disposed legs 46 positioned in a spaced side-by-side orientation. The legs 46 have rearward ends 48 receivable within the pair of larger recesses 26 in the lower edge 16 of the panel portion 12. The legs 46 have forward ends 50 having a storage container 52 secured thereto. The storage container 52 has an elongated semi-cylindrical configuration defined by an open upper end 54 for receiving items therein. The upper end of one of the leg's 46 has a notch 56 extending downwardly thereof while the lower end of the other leg has a notch 56 extending upwardly thereof. This arrangement allows the notches 56 to align and be engaged so that the rearward ends 48 are connected to form an angle. Note FIG. 1. The storage container 52 can be used to hold small jewelry items, such as the ones that would normally be transported in the supplemental small pouch 40 of the travel pouch 34.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable jewelry travel case and display for allowing jewelry to be transported and displayed without being damaged comprising, in combination:

a panel portion having a generally rectangular configuration, the panel portion having an outer periphery defined by an upper edge, a lower edge, and opposed side edges, the outer periphery having a plurality of triangular recesses extending inwardly thereof in a spaced relationship, the lower edge having a pair of larger recesses extending upwardly thereof in a spaced relationship, the panel portion having a plurality of apertures' therethrough in a spaced relationship downwardly of the upper edge, the panel portion having a central recess formed on a front surface thereof;

a travel pouch dimensioned for receiving the panel portion therein, the travel pouch having an open upper end for receiving the travel pouch therein, the open upper end including a closable cover, the travel pouch having a supplemental small pouch disposed on a front surface thereof, the supplemental small pouch having an open upper end including a closable flap; and a base stand adapted for supporting the panel portion in an upright orientation, the base stand being comprised of a pair of horizontally disposed legs positioned in a spaced side-by-side orientation, the legs having rearward ends receivable within the pair of larger recesses in the lower edge of the panel portion, the legs having forward ends having a storage container secured thereto, the storage container having an elongated semi-cylindrical configuration defined by an open upper end for receiving items therein.

2. A portable jewelry travel case and display for allowing jewelry to be transported and displayed without being damaged comprising, in combination:

a panel portion having an outer periphery defined by an upper edge, a lower edge, and opposed side edges, the outer periphery having a plurality of triangular recesses extending inwardly thereof in a spaced relationship, the lower edge having a pair of larger recesses extending upwardly thereof in a spaced relationship; and a base stand adapted for supporting the panel portion in an upright orientation, the base stand comprising a pair of horizontally disposed legs positioned in a spaced side-by-side orientation, the legs having rearward ends receivable within the pair of larger recesses in the lower edge of the panel portion.

3.The portable jewelry travel case and display as set forth in claim two, wherein the legs have forward ends having a storage container secured thereto.

4. The portable jewelry travel case and display as set forth in claim 3, wherein the storage container has an elongated semi-cylindrical configuration defined by an open upper end for receiving items therein.

* * * * *